US006284070B1

(12) United States Patent
Gorman et al.

(10) Patent No.: US 6,284,070 B1
(45) Date of Patent: Sep. 4, 2001

(54) HEAT TREATMENT FOR IMPROVED PROPERTIES OF ALPHA-BETA TITANIUM-BASE ALLOYS

(75) Inventors: Mark D. Gorman, West Chester, OH (US); Andrew P. Woodfield, Highland Heights, KY (US); Barbara A. Link, West Chester, OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/384,911

(22) Filed: Aug. 27, 1999

(51) Int. Cl.[7] ..... C22F 1/18
(52) U.S. Cl. ..... 148/668; 148/671; 148/421
(58) Field of Search ..... 148/669, 671, 148/421

(56) References Cited

U.S. PATENT DOCUMENTS 3,833,363 * 9/1974 Bomberger, Jr. et al. ..... 148/133
3,901,743 * 8/1975 Sprague et al. ..... 148/133

* cited by examiner

*Primary Examiner*—John Sheehan
*Assistant Examiner*—Andrew L. Oltmans
(74) *Attorney, Agent, or Firm*—Andrew C. Hess; David L. Narciso

(57) ABSTRACT

An alpha-beta titanium-base alloy is heat treated to improve its dwell fatigue properties while retaining a good balance of mechanical properties. The heat treatment includes first heating the alpha-beta titanium-base alloy to a first heat-treatment temperature in a first range of from about 70° F. below a beta transus temperature of the alpha-beta titanium-base alloy to the beta transus temperature of the alpha-beta titanium-base alloy, and quenching the alpha-beta titanium-base alloy at a rate of greater than about 200° F. per minute. The alpha-beta titanium-base alloy is second heated to a second heat-treatment temperature in a second range of from about 100° F. to about 400° F. below the beta transus temperature of the alpha-beta titanium-base alloy, and thereafter cooling the alpha-beta titanium-base alloy to ambient temperature at a rate of from about 10° F. per minute to about 200° F. per minute.

21 Claims, 2 Drawing Sheets

HEAT TREATMENT FOR IMPROVED PROPERTIES OF ALPHA-BETA TITANIUM-BASE ALLOYS

FIELD OF THE INVENTION

This invention relates to the heat treatment of titanium alloys, and, more particularly, to the heat treatment of alpha-beta titanium-base alloys to improve their dwell fatigue performance.

BACKGROUND OF THE INVENTION

An alpha-beta titanium-base alloy exhibits an alpha-plus-beta phase field in its temperature-composition equilibrium phase diagram. These alpha-beta titanium-base alloys may be heat treated for improved performance. Alpha-beta titanium-base alloys are used in applications requiring good mechanical performance at intermediate temperatures, coupled with their relatively low density. For example, such alpha-beta titanium-base alloys are used in compressor blades, disks, and structures of aircraft engines, where the article is expected to perform at temperatures of up to about 1100° F.

Alpha-beta titanium-base alloys are potentially susceptibility to dwell fatigue damage. In dwell fatigue, the material is loaded and held with the load applied for a period of time, and then unloaded. The loading and unloading cycle is repeated numerous times. Such loading conditions are experienced in typical situations of use of the alpha-beta titanium-base alloys. Under these conditions, the alpha-beta titanium-base alloy may crack and fail prematurely.

There is a need for an approach that reduces the incidence of dwell fatigue in alpha-beta titanium-base alloys, while retaining the other beneficial properties of the material. The present invention fulfills this need, and further provides related advantages.

BRIEF SUMMARY OF THE INVENTION

The present invention provides a method for heat treating an alpha-beta titanium-base alloy to reduce its susceptibility to dwell fatigue damage. Other beneficial properties of the alpha-beta titanium-base alloy are retained, such as good strength, ductility, fracture toughness, crack growth resistance, and machinability. The heat treatment is accomplished with conventional equipment.

A heat treatment is provided for an alpha-beta titanium-base alloy capable of forming mixtures of alpha and beta phases and having a beta transus between an alphaplus-beta phase field and a beta phase field of a temperature-composition equilibrium phase diagram of the alpha-beta titanium-base alloy. The method for heat treating the alpha-beta titanium-base alloy comprises the steps of first heating the alpha-beta titanium-base alloy to a first heat-treatment temperature within the alpha-plus-beta phase field and which produces a volume fraction of primary alpha phase of less than about 30 percent within a beta phase matrix, and thereafter quenching the alpha-beta titanium-base alloy at a rate sufficient to suppress the epitaxial regrowth of the primary alpha phase during cooling and to produce a transformed beta morphology in the beta phase. The alpha-beta titanium-base alloy is thereafter second heated to a second heat-treatment temperature less than a growth temperature at which a primary alpha phase level is substantially affected by epitaxial growth and greater than an ordering temperature at which an ordering reaction occurs, and thereafter cooled at a rate sufficient to avoid ordering reactions in the alpha-beta titanium-base alloy.

The first heating produces a microstructure having a low volume fraction of primary alpha phase, and the quenching suppresses the growth of the alpha phase. The result is a microstructure having a relatively small amount of primary alpha phase and a Widmanstatten or martensitic transformed beta morphology. The second heating is conducted at a temperature whereat the alpha phase does not significantly coarsen, and the transformed beta phase coarsens. The result is an improved balance in mechanical properties with an accompanying microstructure having low susceptibility to dwell fatigue. The alpha-beta titanium-base alloy is thereafter cooled at a slow or intermediate rate sufficient to avoid ordering reactions in the alpha-beta titanium-base alloy.

The heat treatment may be utilized with a wide variety of alpha-beta titanium-base alloys, with examples being Ti-6242 alloy and Alloy 834. In practice, the first heat-treatment temperature is preferably in a first range of from about 70° F. below a beta transus temperature of the alpha-beta titanium-base alloy to the beta transus temperature of the alpha-beta titanium-base alloy, more preferably from about 70° F. below the beta transus temperature of the alpha-beta titanium-base alloy to about 10° F. below the beta transus temperature of the alpha-beta titanium-base alloy. The quenching is typically at a rate of greater than 200° F. per minute to a temperature of less than an aging temperature for the alloy, which is about 1100° F. for Ti-6242 alloy and about 1300° F. for Alloy 834. The step of second heating is preferably accomplished by heating the alpha-beta titanium-base alloy to a second heat-treatment temperature in a second range of from about 100° F. to about 400° F. below the beta transus temperature of the alpha-beta titanium-base alloy. The step of cooling is preferably accomplished by cooling the alpha-beta titanium-base alloy to ambient temperature at a rate of from about 10° F. per minute to about 200° F. per minute.

After the heat treatment described above, the alpha-beta titanium-base alloy may be further heat treated by aging the alpha-beta titanium-base alloy, typically at a temperature of from about 950° F. to about 1350° F., depending upon the alloy and properties desired.

The result of this heat treatment is a desirable balance of properties including good strength, ductility, fracture toughness, crack growth resistance, and machinability, accompanied by good resistance to dwell fatigue. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
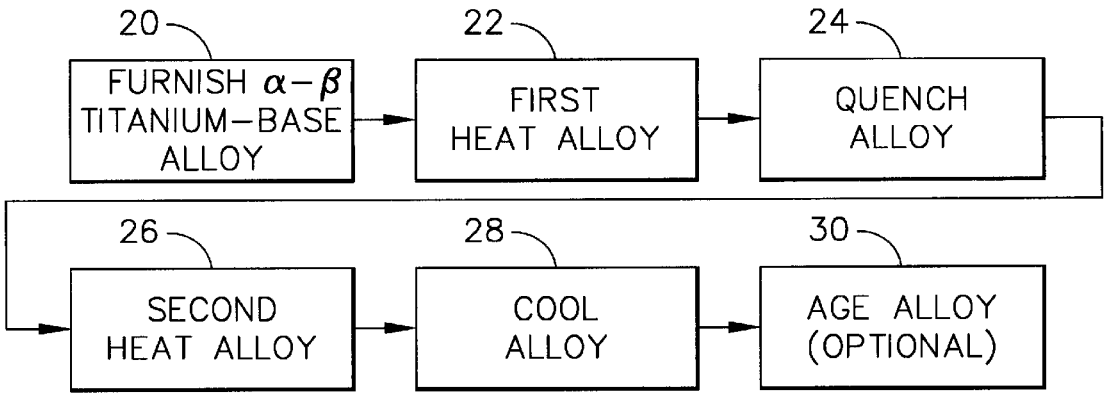
FIG. 1 is a block flow diagram of a method for heat treating an alpha-beta titanium-base alloy according to the present approach.
Figure 2:
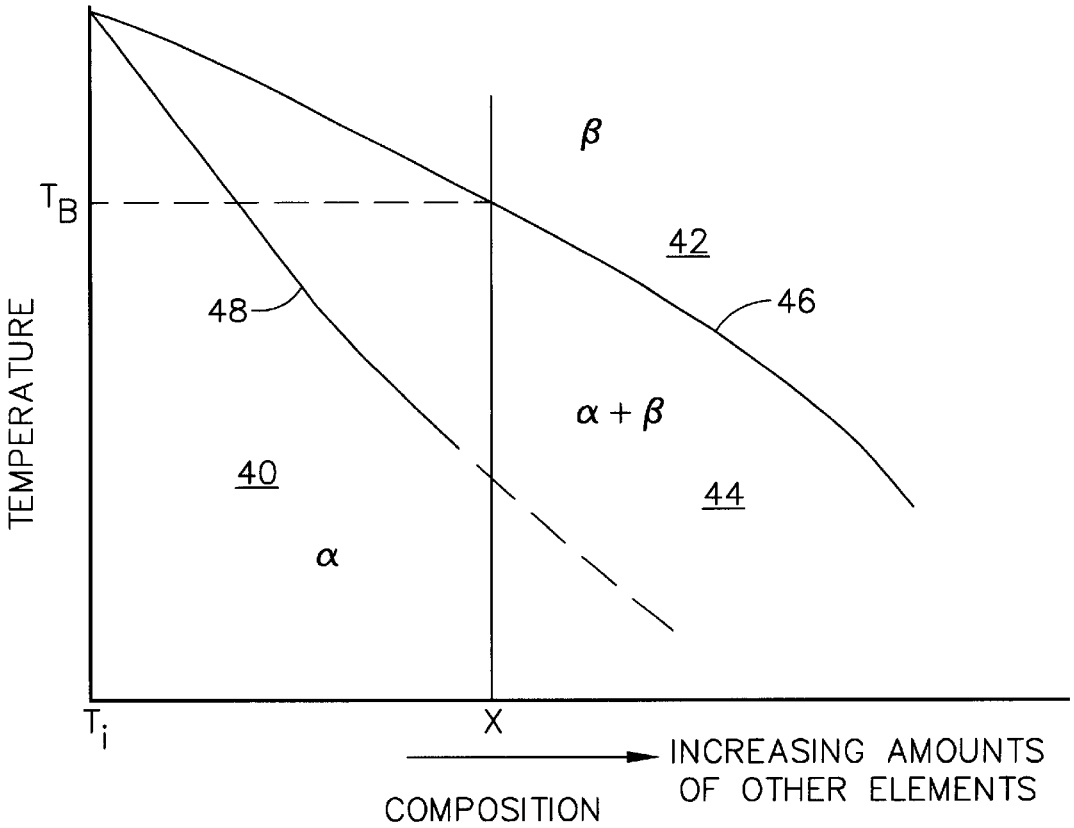
FIG. 2 is a portion of a temperature-composition equilibrium phase diagram illustrating the pertinent features of the alpha-beta titanium-base alloy.

FIG. 1 is a block flow diagram of a procedure for practicing the approach of the invention. A titanium-base alloy capable of forming mixtures of alpha (α) and beta (β) phases, commonly called an alpha-beta (α–β) titanium-base alloy, is furnished, numeral 20. Alpha (α) phase is an hexagonal close packed (HCP) phase thermeodynamically stable at lower temperatures, beta (β) phase is a body centered cubic (BCC) phase thermodynamically stable at higher temperatures, and a mixture of alpha and beta phases is thermodynamically stable at interz ediate temperatures. FIG. 2 is an idealized temperature-composition equilibrium phase diagram for such an alpha-beta titanium-base alloy. The alpha-beta titanium-base alloy is "titanium base", meaning that it has more titanium than any other element. In a typical case, the alpha-beta titanium-base alloy, whose composition is represented by a vertical line X in FIG. 2, has more than about 70weight percent titanium, with the balance other elements. Some examples of operable titanium-base alloys for use with the present invention include Alloy 834, having a nominal composition, in weight percent, of about 5.8 percent aluminum, about 4.0percent tin, about 3.5 percent zirconium, about 0.5 percent molybdenum, about 0.35percent silicon, about 0.7 percent niobium, about 0.06 percent carbon, balance titanium and impurities; and Ti-6242, having a nominal composition, in weight percent, of about 6 percent aluminum, about 2 percent tin, about 4 percent zirconium, about 2 percent molybdenum, about 0.1 percent silicon, balance titanium and impurities. The use of the present invention is not, however, limited to these named alloys.

The alpha-beta titanium-base alloys of most interest, and with which the present invention is most beneficially used, are those which are susceptible to dwell fatigue damage. "Dwell fatigue" refers to a type of cyclic loading in which the alloy is loaded, held in the loaded state for a period of time, and unloaded, and the cycle is repeated. Fractures are typically characterized by faceted internal fatigue crack initiations and reduced fatigue life compared to an otherwise-identical stress cycle that does not include a dwell in the loaded state. Typically, titanium-base alloys designed for high-temperature service are balanced so that the high alpha phase levels are stable and the alloys are susceptible to dwell fatigue. Alloys 834 and Ti-6242 are examples of alpha-beta titanium-base alloys susceptible to dwell fatigue.

As shown in FIG. 2, the temperature-composition equilibrium phase diagram of the alpha-beta titanium-base alloy includes an alpha (α) phase field 40, a beta (β) phase field 42, and an alpha-plus-beta (α–β) phase field 44 lying between the alpha phase field 40 and the beta phase field 42. A line termed the beta transus 46 lies between and separates the alpha-plus-beta phase field 44 and the beta phase field 42, and a line termed the alpha transus 48 lies between and separates the alpha-plus-beta phase field and the alpha phase field.

The phase diagram of FIG. 2 is an equilibrium phase diagram representing conditions of thermodynamic equilibrium, and the condition of thermodynamic stability may not be reached at all temperatures, particularly at low temperatures. The alpha phase field 40 is seldom attained due to the slower kinetics at low temperatures and the complexities of the alpha-beta titanium-base alloys. At low temperatures, a mixture of phases is typically observed, as will be discussed subsequently. Nevertheless, the equilibrium phase diagram of FIG. 2 is a useful tool for discussion and analysis of the present approach, because reference to the equilibrium phase diagram and description of the invention in terms of the equilibrium phase diagram allows a unified, unambiguous discussion of alpha-beta titanium-base alloys of different compositions.

The alpha-beta titanium-base alloy is first heated to a first heat-treatment temperature within the alpha-plus-beta phase field, numeral 22, which produces a volume fraction of primary alpha phase of less than about 30 percent within a primary beta phase matrix. The first heat-treatment temperature is preferably in a first range of from about 70° F. below a beta transus temperature Tβof the alpha-beta titanium-base alloy to the beta transus temperature of the alpha-beta titanium-base alloy. (The beta transus temperature Tβof the alpha-beta titanium-base alloy is the temperature at which the vertical line X representing the composition of the alpha-beta titanium-base alloy crosses the beta transus 46.) More preferably, the first range is from about 70° F. below the beta transus temperature Tβto about 10° F. below the beta transus temperature Tβ. The alpha-beta titanium-base alloy is held at the first heat-treatment temperature for a period of time sufficient that the equilibrium phase fractions are approached and ideally attained. This time required depends upon the size of the article being heat treated, but is typically in the range of from about 30 minutes to about 4 hours. By performing the first heating in this temperature range just below the beta transus temperature Tβ, a desirably small volume fraction of primary alpha phase is established.

After the first heating 22 is complete, the alpha-beta titanium-base alloy is thereafter quenched at a rate sufficient to suppress the formation of substantial amounts of additional primary alpha phase and to produce a transformed beta morphology in the beta phase, numeral 24. The alpha-beta titanium-base alloy is quenched to a quenching temperature sufficiently low that undesirable ordered phases such as $Ti_3Al$ are suppressed. This quenching temperature is typically from about room temperature to about 1400° F., but is preferably about room temperature. The required quenching rate is typically greater than about 200° F., and the alpha-beta titanium-base alloy is typically quenched to a temperature of less than the aging temperature for the alloy, which is about 1100° F. for Ti-6242 alloy and about 1300° F. for Alloy 834.

The quenching 24 retains the low volume fraction of primary alpha phase in the quenched alpha-beta titanium-base alloy by suppressing epitaxial regrowth of the primary alpha phase during cooling. That is, there is insufficient time for substantial additional growth of the primary alpha phase, even though additional alpha phase is expected from the equilibrium phase diagram. The quenching 24 also causes the primary beta phase to transform to a Widmanstatten or a martensitic transformed beta morphology. The term "transformed beta" refers to an acicular or platelet alpha phase with small amounts of retained beta phase. A transformed beta structure forms during cooling of the alloy from the beta phase field or forms from the alpha-beta phase field in competition with epitaxial growth of primary alpha phase. Transformed beta commonly has one of three morphological types, lamellar, Widmanstatten, or martensitic. The lamellar structure results from slower cooling rates, contains essentially one crystallographic variant of alpha phase, and is less desirable in terms of dwell fatigue resistance. The Widmanstatten and martensitic structures, which result from higher cooling rates, are distinct morphologies of the alpha phase that contains multiple crystallographic variants of the alpha phase, and lead to improved dwell fatigue capability. However, the multiple alpha orientations associated with Widmanstatten and martensitic structures also contribute to higher strengths and reduced toughness and ductility, and/or have high levels of residual stress present, and for these reasons additional heat treatment is required.

After the quenching 24 is complete, the alpha-beta titanium-base alloy is thereafter second heated to a second heat-treatment temperature less than a growth temperature at which a primary alpha phase level is substantially affected by epitaxial growth and greater than an ordering temperature at which an ordering reaction (such as the formation of $Ti_3Al$) occurs, numeral 26. That is, there is little additional growth of alpha phase, although some minor amount of growth may occur, and intermetallic compounds such as $Ti_3Al$ are not formed. The second heat-treatment temperature may vary according to the nature of the alpha-beta titanium-base alloy, but it is typically in a second range of from about 100° F. to about 400° F. below the beta transus temperature Tβof the alpha-beta titanium-base alloy. During the second heating 26, the alpha phase is largely unaffected, and the transformed beta phase produced in the quenching step 24 coarsens but retains its crystallographic variants. The alpha-beta titanium-base alloy is held at the second heat-treatment temperature for a period of time sufficient that the transformed beta phase is coarsened. The time required depends upon the size of the article being heat treated, but is typically in the range of from about 30 minutes to about 4 hours. After cooling, this structure has reduced strength and achieves a good balance of mechanical properties.

After the second heating 26 is complete, the alpha-beta titanium-base alloy is thereafter cooled at a rate sufficient to avoid ordering reactions (such as the formation of $Ti_3Al$) in the alpha-beta titanium-base alloy, numeral 28. The cooling rate is typically from about 10° F. per minute to about 200° F. per minute, to a temperature such that the formation of undesirable ordered phases such as $Ti_3Al$ is suppressed. This temperature to which the alloy must be cooled is typically from about room temperature to about 1400° F., but is preferably about room temperature. This cooling step 28 retains the structure achieved in the second heating step 26, and avoids the formation of other phases such as the ordered phase $Ti_3Al$. The lower cooling rate also results in lower residual stress and improved machinability.

After the cooling step 28 is complete, the alpha-beta titanium-base alloy may thereafter be optionally further processed, such as by an aging heat treatment, numeral 30. The aging treatment is accomplished by heating the alpha-beta titanium-base alloy to an aging temperature which is greater than room temperature but below the first heat-treatment temperature and below the second heat-treatment temperature. The aging treatment may have any of several effects, including reduction of residual stress, stabilization of the microstructure (i.e., change to a structure that is closer to equilibrium to minimize changes during service), and/or increase the strength by a small amount. For the aging of alpha-beta titanium-base alloys, the aging temperature is typically in the range of from about 950° F. to about 1350° F. The alpha-beta titanium-base alloy is held at the aging temperature for a period of time sufficient that the desired effects occur. This time required depends upon the size of the article being aged and the alloy, but is typically in the range of from about 1 hour to about 12 hours.

The following is a preferred approach for practicing the invention with the preferred Ti-6242 alloy, which has a beta transus temperature Tβof about 1825° F., using the approach described above. The first heating 22 is at a temperature of about 1800° F. for a time of about 1 hour after the article reaches thermal equilibrium. The quenching 24 is accomplished in water with a quench rate of about 600° F. per minute, to room temperature. The second heating 28 is at a temperature of about 1600° F. for a time of about 1 hour after the article reaches thermal equilibrium. The cooling 28 is an air cool at a rate of about 100° F. per minute, to room temperature. The optional aging 30 is at an aging temperature of about 1100° F. for a time of about 8 hours after the article reaches thermal equilibrium, followed by an air cool.

Figure 3:
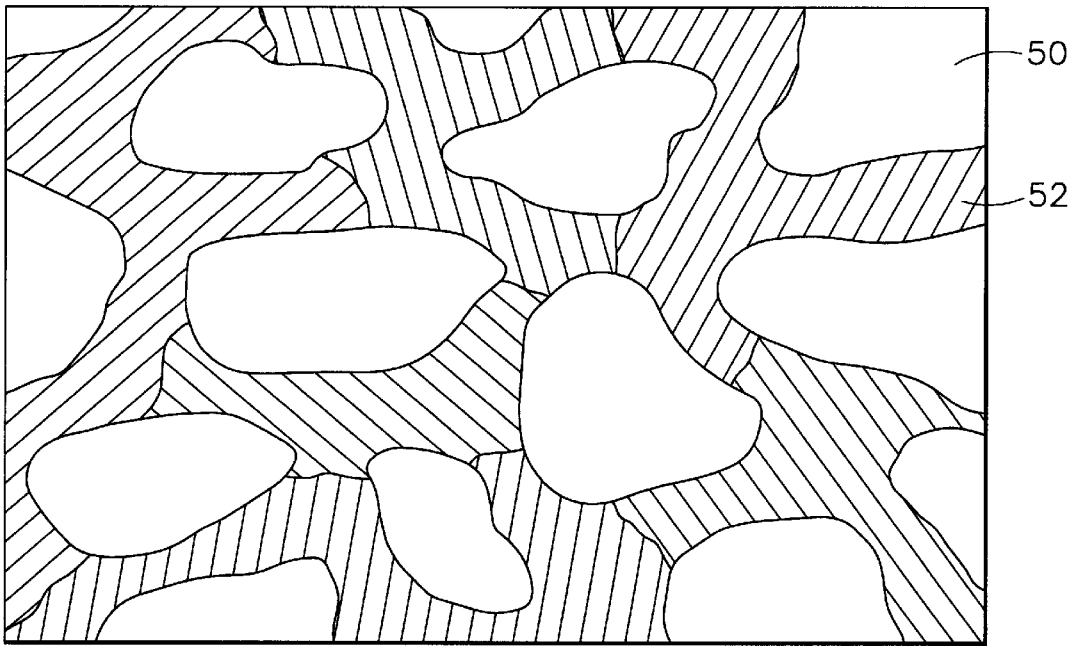
FIG. 3 is a drawing of an idealized microstructure illustrating an alpha-beta titanium-base alloy that is more susceptible to dwell fatigue.
Figure 4:
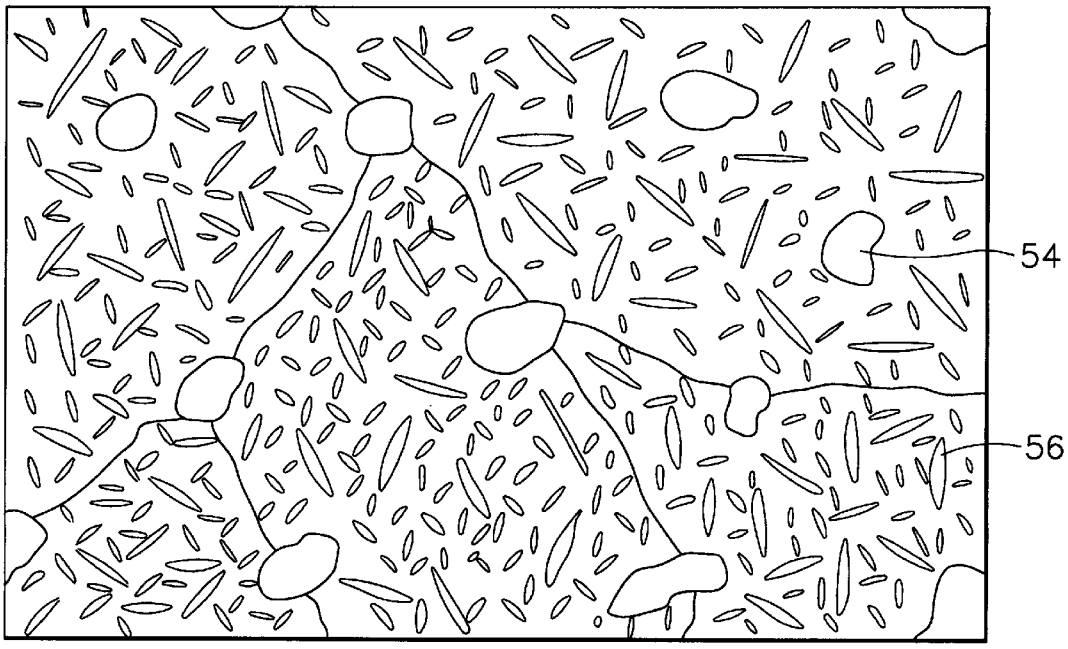
FIG. 4 is a drawing of an idealized microstructure illustrating an alpha-beta titanium-base alloy that is less susceptible to dwell fatigue.

FIG. 3 depicts a microstructure of an alpha-beta titanium-base alloy that is not processed by the present approach and is susceptible to dwell fatigue damage. There is a relatively high volume fraction of alpha phase 50, more than about 50 percent by volume, dispersed within a lamellar transformed beta phase 52. The primary alpha phase is largely crystallographically aligned, with the individual volumes of alpha phase in close crystallographic alignment with their neighbors. This material is relatively susceptible to dwell fatigue damage. FIG. 4, by contrast, depicts a microstructure of an alpha-beta titanium-base alloy that is processed by the present approach and has little if any susceptibility to dwell fatigue damage. In this case, there is a relatively low volume fraction primary alpha phase 54, less than about 30 percent by volume, dispersed within a transformed and coarsened Widmanstaitten (in this case) or martensitic beta phase 56. Even if there is some minor degree of crystallographic alignment of the individual volumes of alpha phase, the relatively low volume fraction of alpha phase limits any adverse effect of the crystallographic alignment.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for heat treating a material, comprising the steps of:

furnishing an alpha-beta titanium-base alloy capable of forming mixtures of alpha and beta phases and having a beta transus between an alpha-plus-beta phase field and a beta phase field of a temperature-composition equilibrium phase diagram of the furnished alpha-beta titanium-base alloy; thereafter first heating the alpha-beta titanium-base alloy to a first heat-treatment temperature within the alpha-plus-beta phase field, the step of first heating producing a volume fraction of primary alpha phase of less than about 30percent within a primary beta phase matrix; thereafter quenching the alpha-beta titanium-base alloy at a rate sufficient to suppress the epitaxial regrowth of the primary alpha phase and to produce a transformed beta morphology in the beta phase; thereafter second heating the alpha-beta titanium-base alloy to a second heat-treatment temperature less than a growth temperature at which a primary alpha phase level is substantially affected by epitaxial growth and greater than an ordering temperature at which an ordering reaction occurs; and thereafter cooling the alpha-beta titanium-base alloy at a rate sufficient to avoid ordering reactions in the alpha-beta titanium-base alloy.

2. The method of claim 1, wherein the alpha-beta titanium-base alloy has a nominal composition, in weight percent, selected from the group consisting of (1) about 5.8 percent aluminum, about 4.0 percent tin, about 3.5 percent zirconium, about 0.5 percent molybdenum, about 0.35 percent silicon, about 0.7 percent niobium, about 0.06 percent carbon, balance titanium and impurities; and (2) about 6 percent aluminum, about 2 percent tin, about 4 percent zirconium, about 2 percent molybdenum, about 0.1 percent silicon, balance titanium and impurities.

3. The method of claim 1, wherein the step of first heating includes the step of heating the alpha-beta titanium-base alloy to a first heat-treatment temperature in a first range of from about 70° F. below a beta transus temperature of the alpha-beta titanium-base alloy to the beta transus temperature of the alpha-beta titanium-base alloy.

4. The method of claim 1, wherein the step of first heating includes the step of heating the alpha-beta titanium-base alloy to a first heat-treatment temperature in a first range of from about 70° F. below a beta transus temperature of the alpha-beta titanium-base alloy to about 10° F. below the beta transus temperature of the alpha-beta titanium-base alloy.

5. The method of claim 1, wherein the step of quenching includes the step of quenching the alpha-beta titanium-base alloy at a rate of greater than about 200° F. per minute.

6. The method of claim 1, wherein the step of second heating includes the step of heating the alpha-beta titanium-base alloy to a second heat-treatment temperature in a second range of from about 100° F. to about 400° F. below a beta transus temperature of the alpha-beta titanium-base alloy.

7. The method of claim 1, wherein the step of cooling includes the step of cooling the alpha-beta titanium-base alloy to ambient temperature at a rate of from about 10° F. per minute to about 200° F. per minute.

8. The method of claim 1, including an additional step, after the step of cooling the alpha-beta titanium-base alloy, of aging the alpha-beta titanium-base alloy.

9. A method for heat treating a material, comprising the steps of:

furnishing an alpha-beta titanium-base alloy capable of forming mixtures of alpha and beta phases and having a beta transus between an alpha-plus-beta phase field and a beta phase field of a temperature-composition equilibrium phase diagram of the furnished alpha-beta titanium-base alloy; thereafter first heating the alpha-beta titanium-base alloy to a first heat-treatment temperature in a first range of from about 70° F. below a beta transus temperature of the alpha-beta titanium-base alloy to the beta transus temperature of the alpha-beta titanium-base alloy; thereafter quenching the alpha-beta titanium-base alloy at a rate of greater than about 200° F. per minute; thereafter second heating the alpha-beta titanium-base alloy to a second heat-treatment temperature in a second range of from about 100° F. to about 400° F. below the beta transus temperature of the alpha-beta titanium-base alloy; and thereafter cooling the alpha-beta titanium-base alloy to ambient temperature at a rate of from about 10° F. per minute to about 200° F. per minute.

10. The method of claim 9, wherein the alpha-beta titanium-base alloy has a nominal composition, in weight percent, selected from the group consisting of (1) about 5.8 percent aluminum, about 4.0 percent tin, about 3.5 percent zirconium, about 0.5 percent molybdenum, about 0.35 percent silicon, about 0.7 percent niobium, about 0.06 percent carbon, balance titanium and impurities; and (2) about 6 percent aluminum, about 2 percent tin, about 4 percent zirconium, about 2 percent molybdenum, about 0.1 percent silicon, balance titanium and impurities.

11. The method of claim 9, wherein the step of first heating includes the step of heating the alpha-beta titanium-base alloy to a first heat-treatment temperature in a first range of from about 70° F. below a beta transus temperature of the alpha-beta titanium-base alloy to about 10° F. below the beta transus temperature of the alpha-beta titanium-base alloy.

12. The method of claim 9, including an additional step, after the step of cooling the alpha-beta titanium-base alloy, of aging the alpha-beta titanium-base alloy at a temperature of from about 950° F. to about 1350° F.

13. A method for heat treating a material, comprising the steps of:

furnishing an alpha-beta titanium-base alloy capable of forming mixtures of alpha and beta phases and having a beta transus between an alpha-plus-beta phase field and a beta phase field of a temperature-composition equilibrium phase diagram of the alpha-beta titanium-base alloy; thereafter first heating the alpha-beta titanium-base alloy to a first heat-treatment temperature within the alpha-plus-beta phase field, the step of first heating producing a volume fraction of primary alpha phase of less than about 30 percent within a primary beta phase matrix; thereafter quenching the alpha-beta titanium-base alloy at a rate sufficient to suppress the epitaxial regrowth of the primary alpha phase and to produce a transformed beta morphology in the beta phase; thereafter second heating the alpha-beta titanium-base alloy to a second heat-treatment temperature less than a growth temperature at which a primary alpha phase level is substantially affected by epitaxial growth and greater than an ordering temperature at which an ordering reaction occurs; and thereafter cooling the alpha-beta titanium-base alloy at a rate sufficient to avoid ordering reactions in the alpha-beta titanium-base alloy, the microstructure resulting after the step of cooling having less than about 30 percent by volume of primary alpha phase dispersed within a transformed and coarsened matrix phase selected from the group consisting of transformed and coarsened Widmanstatten phase and martensitic beta phase.

14. The method of claim 13, wherein the alpha-beta titanium-base alloy has a nominal composition, in weight percent, selected from the group consisting of (1) about 5.8 percent aluminum, about 4.0 percent tin, about 3.5 percent zirconium, about 0.5 percent molybdenum, about 0.35 percent silicon, about 0.7 percent niobium, about 0.06 percent carbon, balance titanium and impurities; and (2) about 6 percent aluminum, about 2 percent tin, about 4 percent zirconium, about 2 percent molybdenum, about 0.1 percent silicon, balance titanium and impurities.

15. The method of claim 13, wherein the step of first heating includes the step of heating the alpha-beta titanium-base alloy to a first heat-treatment temperature in a first range of from about 70° F. below a beta transus temperature of the alpha-beta titanium-base alloy to the beta transus temperature of the alpha-beta titanium-base alloy.

16. The method of claim 13, wherein the step of first heating includes the step of heating the alpha-beta titanium-base alloy to a first heat-treatment temperature in a first range of from about 70° F. below a beta transus temperature of the alpha-beta titanium-base alloy to about 10° F. below the beta transus temperature of the alpha-beta titanium-base alloy.

17. The method of claim 13, wherein the step of quenching includes the step of quenching the alpha-beta titanium-base alloy at a rate of greater than about 200° F. per minute.

18. The method of claim 13, wherein the step of second heating includes the step of heating the alpha-beta titanium-base alloy to a second heat-treatment temperature in a second range of from about 100° F. to about 400° F. below a beta transus temperature of the alpha-beta titanium-base alloy.

19. The method of claim 13, wherein the step of cooling includes the step of cooling the alpha-beta titanium-base alloy to ambient temperature at a rate of from about 10° F. per minute to about 200° F. per minute.

20. The method of claim 13, including an additional step, after the step of cooling the alpha-beta titanium-base alloy, of aging the alpha-beta titanium-base alloy.

21. A method for heat treating a material, comprising the steps of:

furnishing an alpha-beta titanium-base alloy capable of forming mixtures of alpha and beta phases and having a beta transus between an alpha-plus-beta phase field and a beta phase field of a temperature-composition equilibrium phase diagram of the alpha-beta titanium-base alloy; thereafter first heating the alpha-beta titanium-base alloy to a first heat-treatment temperature in a first range of from about 70° F. below a beta transus temperature of the alpha-beta titanium-base alloy to the beta transus temperature of the alpha-beta titanium-base alloy; thereafter quenching the alpha-beta titanium-base alloy at a rate of greater than about 200° F. per minute; thereafter second heating the alpha-beta titanium-base alloy to a second heat-treatment temperature in a second range of from about 100° F. to about 400° F. below the beta transus temperature of the alpha-beta titanium-base alloy; and thereafter cooling the alpha-beta titanium-base alloy to ambient temperature at a rate of from about 10° F. per minute to about 200° F. per minute, the microstructure resulting after the step of cooling having less than about 30 percent by volume of primary alpha phase dispersed within a transformed and coarsened matrix phase selected from the group consisting of transformed and coarsened Widmanstatten phase and martensitic beta phase.

* * * * *